US005167480A

United States Patent [19]

Gilman et al.

[11] Patent Number: 5,167,480

[45] Date of Patent: * Dec. 1, 1992

[54] RAPIDLY SOLIDIFIED HIGH TEMPERATURE ALUMINUM BASE ALLOY RIVETS

[75] Inventors: Paul S. Gilman, Suffern, N.Y.; Michael S. Zedalis, Randolf, N.J.

[73] Assignee: Allied-Signal Inc., Morristownship, Morris County, N.J.

[ * ] Notice: The portion of the term of this patent subsequent to Feb. 6, 2007 has been disclaimed.

[21] Appl. No.: 650,113

[22] Filed: Feb. 4, 1991

[51] Int. Cl.[5] ..... F16B 19/04; B22F 9/00; C22C 5/00

[52] U.S. Cl. ..... 411/500; 419/33; 419/67; 75/249

[58] Field of Search ..... 419/33, 41, 67; 72/262, 72/711; 10/27 E; 411/500, 504; 75/249

[56] References Cited

U.S. PATENT DOCUMENTS 4,552,520 11/1985 East et al. .
4,566,303 1/1986 McKenna .
4,867,806 9/1989 Shiina ..... 419/67
4,869,751 9/1989 Zedalis et al. ..... 419/67
4,878,967 11/1989 Adam et al. ..... 419/67
4,879,095 11/1989 Adam et al. ..... 419/67
4,898,612 2/1990 Gilman et al. .

FOREIGN PATENT DOCUMENTS 1370894 10/1974 United Kingdom .
2069389 B 8/1981 United Kingdom .

*Primary Examiner*—Neill A. Wilson
*Attorney, Agent, or Firm*—Ernest D. Buff; Gerhard H. Fuchs

[57] ABSTRACT

A rivet is formed from a friction-actuated extrustion. The extrusion is produced by a process that utilizes a comminuted rapidly solidified aluminum alloy ribbon as the in-feed for a continuous friction-actuated extruder. Gumming and flow problems are eliminated. The extruded product is devoid of surface blistering. The extrusion is converted into a rivet that has improved ambient and elevated temperature mechanical properties.

13 Claims, 3 Drawing Sheets

RAPIDLY SOLIDIFIED HIGH TEMPERATURE ALUMINUM BASE ALLOY RIVETS

BACKGROUND OF THE INVENTION

1. Field of the Invention

The present invention relates to rivets for use in aerospace structures, and more particularly to rivets formed from friction-actuated extrusions of comminuted rapidly solidified aluminum base alloy powder.

2. Description of the Prior Art

In a "friction-actuated" extrusion process, metal is fed into one end of a passageway formed between first and second members, with the second member having a greater surface area for engaging the metal than the first member. The passageway has an obstruction at the end remote from the end into which the metal is fed. At least one die orifice of the passageway is associated with the obstructed end. The passageway-defining surface of the second member moves relative to the passageway-defining surface of the first member in the direction towards the die orifice from the first end to the obstructed end. Frictional drag of the passageway-defining surface of the second member draws the metal through the passageway and generates therewithin a pressure that is sufficient to extrude the metal through the die orifice. The obstructed end of the passageway may be blocked substantially entirely as described in British Patent Specification No. 1370894. In conventional practice, such as the conform process described in U.S. Pat. Nos. 4552520 and 4566303, the passageway is arcuate and the second member is a wheel with a grove formed in its surface. The first member projects into the grove and the obstructed end is defined by an abutment projecting from the first member. Preferably, the abutment member is of substantially smaller cross-section than the passageway, so that it leaves a substantial gap between the abutment member and the groove surface. In this case metal adheres to the groove surface, as described in UK Patent No. 2069389B, whereby a portion of the metal extrudes through the clearance and remains as a lining in the groove to re-enter the passageway at the entry end, while the remainder of the metal extrudes through the die orifice.

The conform process was originally developed for the extrusion of metal rod in-feed. Attempts have been made to provide an in-feed in the form of granules. The ability to extrude aluminum and/or aluminum alloys from granular in-feed has proven to be difficult because the aluminum powder does not have adequate flow to sustain the process. This is especially true for high performance aluminum alloys such as those prepared from inert or flue gas atomization or mechanical alloying. Alloy granules produced by these processes have morphologies that render the in-feed non-flowable. In addition, the high hardness of the granules makes the actual friction-actuated extrusion difficult. To avoid flow problems associated with aluminum alloy granules having high hardness, efforts have been made to conform in-feed composed of softer aluminum and/or aluminum alloy granules. In such processes, the soft aluminum granules quickly gum the apparatus and the extruded material is prone to blistering on the surface and failing at the particle surface (i.e., interparticle separation) due to the presence of an oxide layer in the granules. A process for providing a friction actuated extrusion using rapidly solidified and comminuted aluminum alloy as the in-feed to the extruder has been disclosed in U.S. Pat. No. 4,898,612.

At present the riveting of aluminum aircraft structures that are heated either by aerodynamic heating or are in close proximity to the aircraft engines requires the work of stainless steal, nickel base alloy or titanium alloy fasteners. However the material compatibility of the interface fastener with the aluminum structure is a concern for several reasons. Thermal expansion over the wide range of intended operating temperatures is significant. The reliable interface values are best maintained if the rivet and the structural material each have the same coefficient of thermal expansion. If the yield strength of the structural sheet is much less than that of the rivet shank, the surface rivet will often be dimpled during installation. Dimpling is particularly troublesome with thin stack ups. There is a significant weight penalty in using heavier rivets. Rework is very difficult in structures assembled with upset as fasteners having higher strength than the part itself. Drilling a hard fastener out of a softer plate often results in irregular holes in the plate.

Fasteners formed from ingot cast aluminum alloys cannot be used because at temperatures above 150° C. they lose a significant fraction of their strength or are so hard that they cannot be cold headed.

SUMMARY OF THE INVENTION

The present invention provides a product wherein rapidly solidified aluminum-base alloy granules having high hardness are conformed in a highly efficient manner. The conformed product is then converted to a rivet having, in combination, superior properties especially suited for aerospace structural applications.

Generally stated, in the present friction-actuated extrusion process there is used, as in-feed, a comminuted, rapidly solidified aluminum alloy powder. Gumming and flow problems, heretofore encountered in extrusion of such powder, are virtually eliminated. The conformed product is devoid of surface blistering and is especially suited for conversion to an aircraft rivet having improved ambient and elevated temperature mechanical properties.

BRIEF DESCRIPTION OF THE DRAWINGS

The invention will be more fully understood and further advantages will become apparent when reference is made to the following detailed description and the accompanying drawings in which.

DESCRIPTION OF THE PREFERRED EMBODIMENTS

Figure 1:
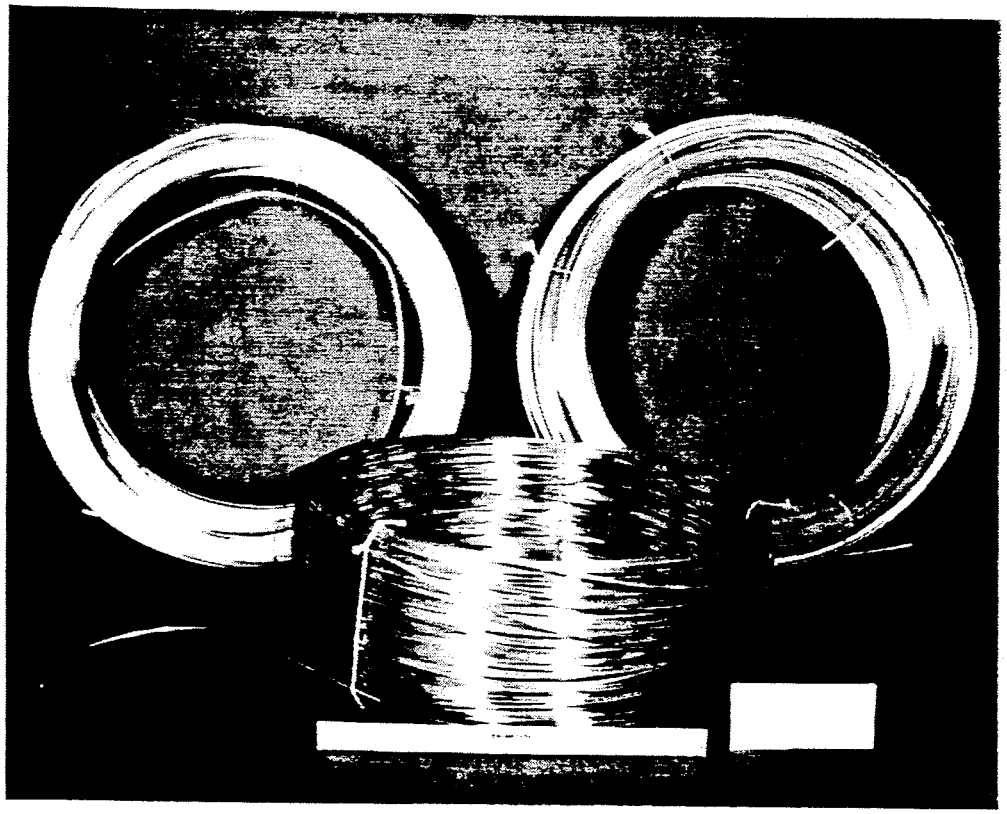
FIG. 1 is a photograph depicting three rolls of wire appointed for conversion into rivets, the wire having been manufactured using a friction-actuated extrusion process.

The rapid solidified ribbon is the product of a melt spinning process selected from the group consisting of jet casting or planar flow casting. In such processes, which are conventional, the melt spun ribbon is produced by injecting and solidifying a liquid metal stream onto a rapidly moving substrate. The ribbon is thereby cooled by conductive cooling rates in the range of $10^5$ to $10^7$ °C./sec. Such processes typically produce homogeneous materials, and permit control of chemical composition by providing for incorporation of strengthening dispersoids into the alloy at sizes and volume fractions unattainable by conventional ingot metallurgy. In general, the cooling rates achievable by melt spinning greatly reduce the size of the intermetallic dispersoids formed during solidification. Furthermore, engineered alloys containing substantially higher quantities of transition elements are able to be produced by rapid solidification with mechanical properties superior to those previously produced by conventional solidification processes. The rapidly solidified ribbon is subsequently pulverized to a particulate, or powder, which is used as the conform in-feed. The particulate can range in particle size from approximately one quarter of an inch (0.635 cm) in diameter to about one thousandth of an inch (0.0025 cm) in diameter. Powder produced by this method is flowable, which property enhances the ability of the material to be successfully conformed. As used herein, the term "flowable" means free flowing and is used in reference to those physical properties of a powder, such as composition, particle fineness, and particle shape, that permit the powder to flow rapidly into a die cavity (see, for example, Metals Handbook, Ninth Edition, Volume 7, Powder Metallurgy, American Society for Metals, p. 278). More specifically, to be flowable or free flowing, the powder must be able to pass through the 2.5mm diameter orifice of a Hall flowmeter funnel, with or without an external pulse (ASTM B 213 and MPIF 3).

The aluminum base, rapidly solidified alloy has a composition consisting essentially of the formula $Al_{bal}Fe_aSi_bX_c$ where X is at least one element selected from the group consisting of Mn, V, Cr, Mo, W, Nb, Ta, "a" ranges from 2.0 to 7.5 at % "b" ranges from 0.5 to 3.0 at % "c" ranges from 0.05 to 3.5 at % and the balance is aluminum plus incidental impurities, with the proviso that the ratio [Fe+X]:Si ranges from about 2.0:1 to 5.0:1. Examples include aluminum-iron-vanadium-silicon alloys, wherein the iron ranges from about 1.5–8.5 at %, vanadium ranges from about 0.25–4.25 at %, and silicon ranges from about 0.5–5.5 at %.

Alternatively, the aluminum base, rapidly solidified alloy has a composition consisting essentially of the formula $Al_{bal}Fe_aSi_bX_c$ wherein X is at least one element selected from the group consisting of Mn, V, Cr, Mo, W, Nb, Ta, "a" ranges from 1.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

An alternative aluminum base, rapidly solidified alloy has a composition range consisting essentially of about 2–15 at % of at least one element selected from the group consisting of zirconium, hafnium, titanium, vanadium, niobium, tantalum and erbium, about 0–5 at % calcium, about 0–5 at % germanium, about 0–2 at % boron, the balance being aluminum plus incidental impurities.

Yet, another alternative low density aluminum base, rapidly solidified alloy has a composition consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at %, "d" ranges from about 0.05 -13 at % and the balance is aluminum plus incidental impurities.

In use of the friction-actuated process from which wire is used to make rivets of the invention as described hereinabove, it has been found that certain disadvantages, such as metal surface blistering, gumming of the equipment and the inability to friction-actuate extrude aluminum alloys with enhanced properties have been overcome. When extruding aluminum alloy from aluminum alloy powder in the conventional way, the aluminum alloy powder must be vacuum degassed at some elevated temperature to remove any gases on the powder surface which may outgas during consolidation, fabrication or use and produce blistering on the metal surface.

The friction-actuated extrusion process hereinabove described is particularly advantageous in that no degassing of the powder in-feed is required prior to friction-actuated extrusion, and the extruded wire requires no degassing.

The friction-actuated extruded wire is especially suited to be fabricated into rivets by conventional techniques such as cold heading.

EXAMPLE I

Thirty kilogram batches of —40 mesh (U.S. standard sieve) powder of the composition aluminum-balance, 4.33 at % iron, 0.33 at % vanadium and 1.72 at % silicon were produced by comminuting rapidly solidified planar flow cast ribbon. The comminuted ribbon was friction-actuated extruded to approximately 4.76mm diameter wire using a conform machine of the type described in UK Pat. No. 2,069,389B. The resulting extruded wire is shown in FIG. 1. The surface of the wire is bright and shows no evidence of surface blistering. The wire is uniform and substantially void-free.

EXAMPLE II

Figure 2:
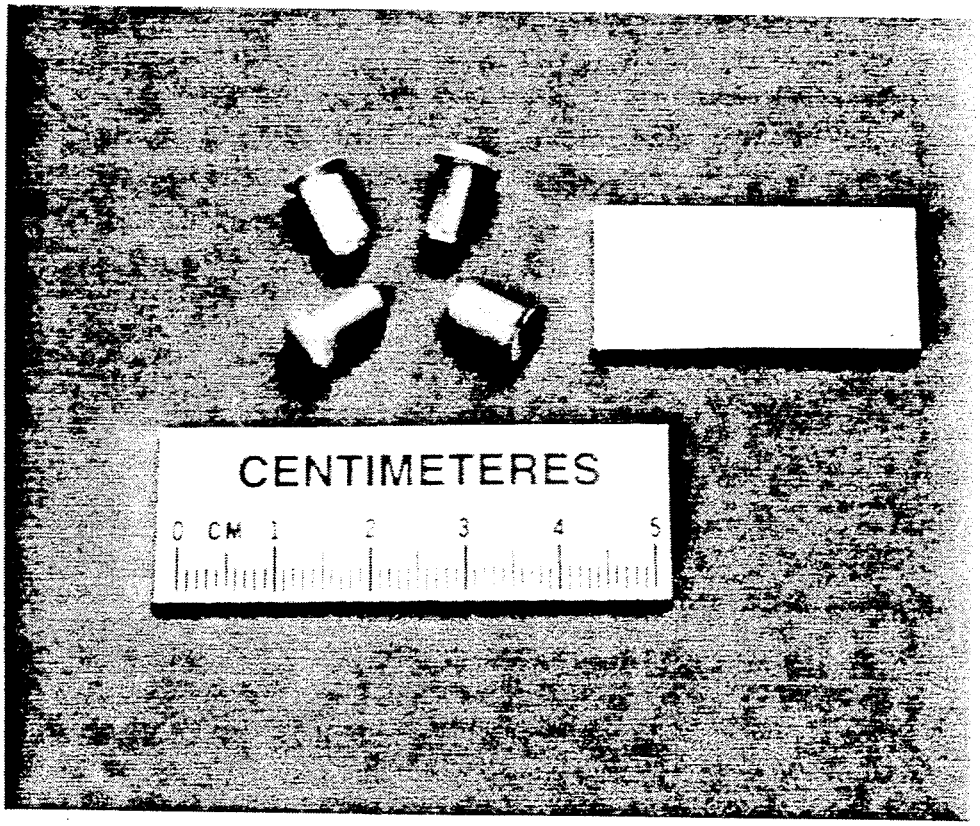
FIG. 2 is a photograph depicting cold headed rivets manufactured from the wire shown in FIG. 1.

The 4.76 mm diameter conformed wire produced in Example I was used to produce various flush head and protruding head rivet geometries using standard cold heading practices. Examples of the cold head rivets are shown in FIG. 2.

EXAMPLE III

The shear strengths of the rivets manufactured in Example II were measured. The following table compares those properties to conventional rivet materials.

| Material | Strength (MPa) | TCE °K. | Density $Mg/M^3$ |
|---|---|---|---|
| Example II Material | 242 | $24.6 \times 10^{-6}$ | 2.83 |
| Ti-6Al-4V | 655 | 9.45 | 4.43 |
| | 338 | 13.32 | 8.84 |
| A286 Stainless Steel | 655 | 17.1 | 7.92 |
| 2024-T4 Aluminum | 282 | 24.7 | 2.77 |

The material of this invention shows exceptional compatibility to structurally wrought aluminum alloy components. For wrought components formed from rapidly solidified high temperature aluminum alloys, the compatibility of the rivet material is markedly enhanced.

EXAMPLE IV

Figure 3:
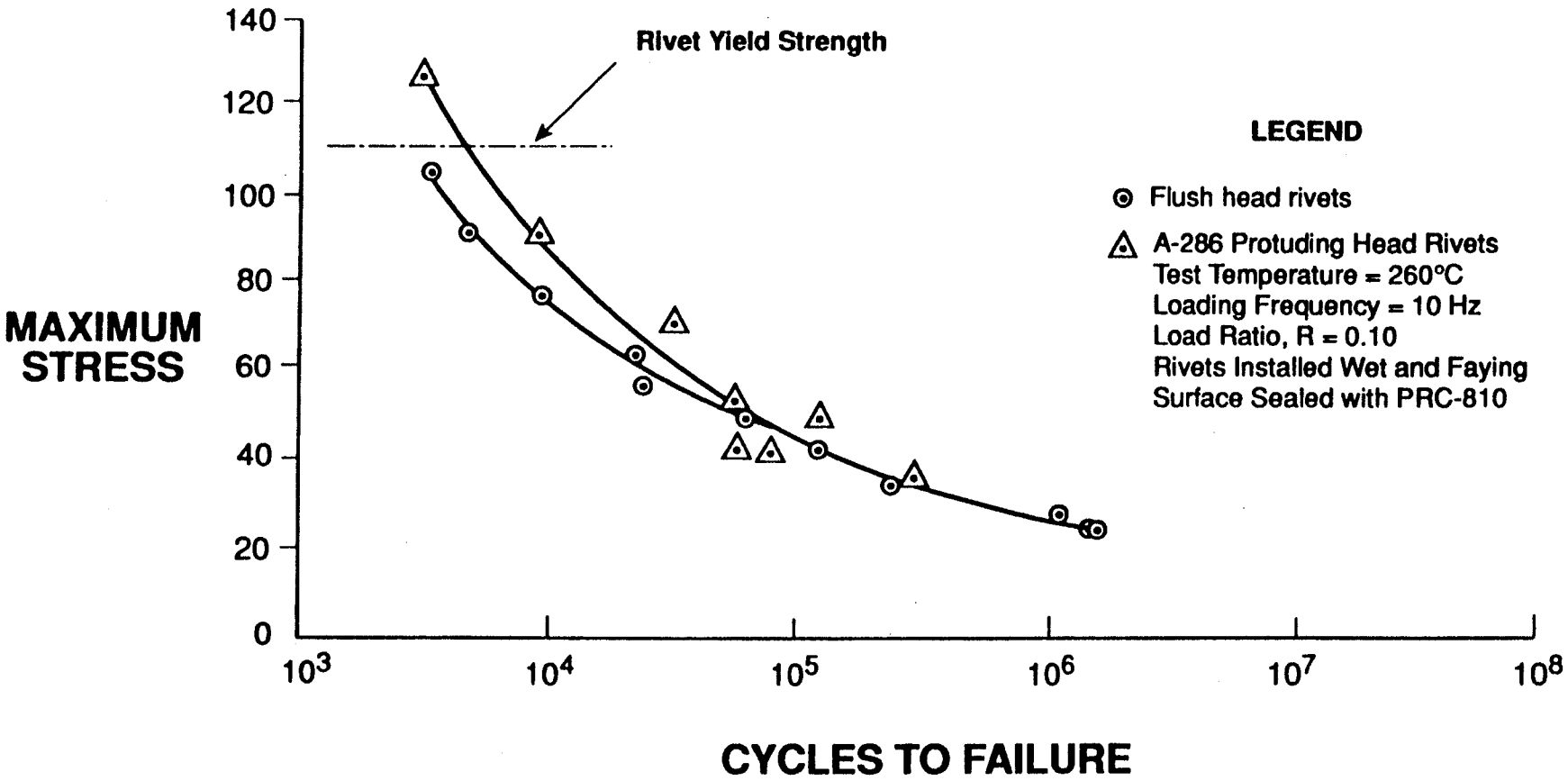
FIG. 3 is a graph comparing the 260° C. lap joint fatigue test results of Example II flush head rivets and A-286 protruding head rivets.

Conformed wire produced in accordance with Example I was fabricated into flush head rivets. The flush head rivets were pneumatically handbucked forming a lap joint with a high temperature Al-Fe alloy sheet used as the structural material, and subjected to a fatigue test at 260° C., as per Mil STd-1312-21. For comparison, a lap joint fabricated with handbucked protruding head A-286 rivets was also fatigue tested. The results shown in FIG. 3 indicate that the pneumatically handbucked flush head rivets fabricated by the method of the present invention exhibited nearly the same elevated temperature strengths as the A-286 stainless steel rivets. Protruding head rivets generally show improved hole interference and thus improved fatigue life. Consequently, the fatigue life of the aluminum rivets should be even greater if comparable rivet geometries were tested. Also if a high temperature fatigue test was employed, the similar CTE's of the aluminum rivets to the aluminum sheet would give enhanced fatigue properties, as compared to the dissimilar rivet material.

These results indicate the excellent compatibility and high temperature strength of rivets produced from the "friction-actuated" extrusions. In addition, the results show that the rivets have a highly stable aluminum alloy structure when formed from friction actuated extruded wire even though such wire is not subjected to outgassing and hot consolidation procedures.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A rivet formed from a friction-actuated extrusion, said extrusion being produced by a continuous process wherein a friction-actuated extruder has, as in-feed, a particulate comminuted from rapidly solidified aluminum alloy ribbon.

2. A rivet as recited in claim 1, wherein said ribbon is the product of a melt spinning process selected from the group consisting of jet casting and planar flow casting.

3. A rivet as recited in claim 1, wherein said in-feed requires no outgassing.

4. A rivet as recited in claim 2, wherein said particulate has a particle size ranging from about 0.0025 to 0.635 centimeters in diameter.

5. A rivet as recited in claim 2, wherein said rapidly solidified aluminum based alloy has a composition consisting essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from about 0.05 to 3.5 at % and the balance is aluminum plus incidental impurities, with the proviso that the ratio [Fe+X]:Si ranges from about 2.0:1 to 5.0:1.

6. A rivet as recited in claim 5, wherein said rapidly solidified aluminum based alloy consists essentially of about 1.5–8.5 at % iron, about 0.25–4.25 at % vanadium, and about 0.5–5.5 at % silicon, the balance being aluminum plus incidental impurities.

7. A rivet as recited in claim 2, wherein said rapidly solidified aluminum based alloy has a composition consisting essentially of the formula $Al_{bal}Fe_aSi_bX_c$, wherein X is at least one element selected from the group consisting of Mn, V, Cr, Mo, W, Nb, Ta, "a" ranges from 1.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

8. A rivet as recited in claim 2, wherein said rapidly solidified aluminum based alloy has a composition consisting essentially of about 2–15 at % is at least one element selected from the group consisting of zirconium, hafnium, titanium vanadium, niobium, tantalum and erbium, about 0–5 at % calcium, about 0–5 at % germanium, about 0–2 at % baron, the balance being aluminum plus incidental impurities.

9. A rivet as recited in claim 2, wherein said rapidly solidified aluminum based alloy has a composition consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at %, "d" ranges from about 0.05–13 at % and the balance is aluminum plus incidental impurities.

10. A rivet formed from a friction-actuated extrusion as recited in claim 1, said rivet being a consolidated, mechanical formable, substantially void free mass.

11. A rivet as recited in claim 10, wherein said mass requires no outgassing.

12. A rivet as recited in claim 6, wherein said particulate has a particle size ranging from about 0.0025 to 0.635.

13. A rivet as recited in claim 4, wherein said particulate is flowable.

* * * * *